United States Patent [19]

Redko et al.

[11] 4,054,009

[45] Oct. 18, 1977

[54] MACHINE FOR SURFACE GRINDING

[76] Inventors: Sergei Georgievich Redko, Naberezhnaya Kosmonavtov, 2, kv. 19; Albert Viktorovich Korolev, Bolskaya Gornaya, 170, kv. 8; Anatoly Fedorovich Maxjushin, Naberezhnaya, dom 1a, kv. 48; Moisei Solomonovich Kreps, ulitsa Gorkogo, 28, kv. 1; Fedor Vasilievich Gorokhov, Vologodskaya ulitsa, 13, kv. 15, all of Saratov, U.S.S.R.

[21] Appl. No.: 629,785

[22] Filed: Nov. 7, 1975

Related U.S. Application Data

[62] Division of Ser. No. 421,635, Dec. 4, 1973, Pat. No. 3,958,371.

[51] Int. Cl.[2] ..... B24B 5/00

[52] U.S. Cl. ..... 51/3; 51/33 W; 51/58

[58] Field of Search ..... 51/58, 291, 165.9, 33 R, 51/33 W, 3

[56] References Cited

U.S. PATENT DOCUMENTS

| | | | |
|---|---|---|---|
| 1,148,691 | 8/1915 | Knowlton | 51/58 |
| 2,604,735 | 7/1952 | Kline | 51/291 X |
| 2,778,170 | 1/1957 | Flanders | 51/58 |
| 2,984,952 | 5/1961 | Gebel | 51/165.9 |
| 3,736,183 | 5/1973 | Schrier | 51/58 X |

*Primary Examiner*—Harold D. Whitehead

[57] ABSTRACT

According to the invention, workpieces are machined by a rocking grinding wheel. In order for the grinding wheel to be given a rocking motion, the inventive grinding machine is provided with a mechanism to impart to the spindle having the grinding wheel thereon a rocking motion in the plane of the wheel. The rocking angle of the grinding wheel may be preset within a range of 360°. Its peripheral speed to within 100 m/min.

4 Claims, 6 Drawing Figures

MACHINE FOR SURFACE GRINDING

This is a divisional of the parent application Ser. No. 421,635, filed Dec. 4, 1973 by the same applicants, titled "METHOD OF SURFACE GRINDING," and now U.S. Pat. No. 3,958,371 issued May 26, 1976.

The present invention relates to the field of abrasive machining and more particularly to surface grinding machines.

The invention may be effectively employed in mechanical engineering for surface grinding of workpieces, particularly in large-lot production where minimizing grinding times without sacrificing quality is the primary consideration, as, for instance, in the manufacture of bearing rings.

It is known in the art to employ a method of surface grinding which uses the principle of mutual linear displacement of the grinding wheel and the workpiece. The distinguishing feature of this known method consists in the low speed of the grinding wheel, about 20 m/min.

This method is known as microgrinding, whereby the entire lateral surface of the grinding wheel, and, hence, all the contacting abrasive grains thereon, interact with the surface being machined. The area of the contacting surface of the grinding wheel and the number of contacting abrasive grains thereon are dependent on the size of the wheel and on the characteristics of the grinding equipment. The greater the number of contacting abrasive grains, the shorter is the time of contact of each one of them with the surface being machined, and the lower is the rate of loading thereof by the final step - lapping. Consequently, the abrasive grains retain their cutting ability till the very end of the microgrinding process. Thus, it is difficult to achieve a high grade of finish or to minimize the grinding time in this method.

Indenting into the rough surface of the workpiece abrasive grains forms comparatively thick chips; consequently, they are subjected to considerable cutting forces so that spalling is observed. As the stock is being removed from the machined surface, the depth of cut decreases so that the spalling is stopped. At this stage, the degree of loading of the abrasive grains which depends on the time of interaction thereof with the surface being machined, is of prime importance if a high grade of finish is to be achieved. Since the number of contacting abrasive grains is constant and too large for them to get loaded, high grades of finish cannot be achieved with comparatively short microgrinding times. This feature constitutes the chief drawback of the known method of surface grinding.

Microgrinding is carried out on a widely known type of grinding machine which comprises a bed with guides carrying a table whereon the workpiece to be machined is positioned and a saddle carrying a spindle with a grinding wheel.

The table moves along the longitudinal guides of the machine bed, while the saddle moves along transverse guides, ensuring the cross feed of the grinding wheel. An asynchronous motor with a reducing gear or a D-C motor is employed as the drive of the grinder. The drive is coupled with the spindle of the grinder by a belt transmission. Owing to the fact that the belt transmission is characterized by low rigidity and there are always clearances in the reducing gear, the workpiece surface is often subjected to waviness which may also arise due to the comparatively low kinematic energy of the slowly rotating wheel.

All the above-mentioned factors do not permit damping the vibrations induced in the machine by the variable component of the cutting forces. For the same reasons rapid cross feed cannot be employed, nor is it possible to remove from the surface being machined the defective layers left over after the preceding grinding operations.

Besides, in order to achieve a high grade of finish, the workpiece is usually ground once or several times on machines specially designed for rough grinding with a coarse-grain wheel and then on higher-precision machines equipped with fine-grain tools. And it is not until after that the workpiece is finished or lapped. Multiple remounting of the workpiece in the course of machining and use of numerous machines and tools add significantly to the amount of time and labour consumed and detract from the quality of machining.

Microgrinding on the known machines is usually carried out at low cross feed values determined by the original roughness of the workpiece. These values are measured in micrometers, so that the machining time increases quite considerably.

It is an object of the present invention to provide a machine for surface finishing and a grinding machine with an improved grinding efficiency, which is conducive to much shorter grinding times and to a high grade of finish of the surface being machined.

Accordingly the invention provides machining whereby the grinding wheel and the workpiece being machined are linearly displaced relative to each other, in which, the grinding wheel in the course of linear displacement is given a rocking motion through an angle of up to 360° relative to the axis thereof, with the peripheral speed of the grinding wheel being chosen depending on the specification requirements for the workpiece as well as on the workpiece material, but not exceeding 100 m/min.

With the grinding wheel rocking, the area of the surface thereof which interacts with the workpiece being machined diminishes, with the corresponding reduction in the number of abrasive grains taking part in the grinding operation. This causes rapid loading of the contacting abrasive grains, thereby raising the grade of finish.

The grinding wheel rocking angle should be preferably reduced in the process of grinding from the initial value to zero, the peripheral speed of the wheel remaining constant throughout.

By varying the wheel rocking angle the number of contacting abrasive grains may be varied, thereby achieving the required roughness of the workpiece surface, whereas the diminution of the rocking angle to zero by the end of the grinding process provides conditions for surface polishing.

The proposed grinding machine comprises a bed with two pairs of guides, one pair of guides carrying a table whereon the workpiece to be machined is positioned, while on the other pair of guides is mounted a saddle carrying a spindle with a grinding wheel.

In accordance with the invention, the grinding machine comprises an attachment which imparts a rocking motion to the spindle having the grinding wheel thereon which mechanism includes a rack with an independent drive whereby the rack can execute a reciprocating motion and a gear interlinked with the rack, the gear being kinematically coupled with the spindle of the grinding wheel.

The drive of the mechanism is preferably formed as an actuating cylinder whereof the piston is mechanically coupled with the rack.

Since the drive of the mechanism is a pneumatic or hydraulic cylinder and the wheel is actuated by a rigid gear practically without a single clearance and capable of balancing the variable component of the cutting forces, it is possible to use large values of cross feed, to remove stock of considerable thickness and to reduce the waviness of the surface being machined.

The exemplary embodiment of the inventive machine will now be described with reference to the accompanying drawings, wherein.

The distinguishing feature of the proposed machine resides in that a grinding wheel 1 (FIGS. 1 and 2) is given a rocking motion relative to the axis thereof through an angle $\alpha$ of up to 360°, the grinding wheel 1 thus rocking while being linearly displaced toward a workpiece 2 in a conventional manner.

With this kind of rocking motion of the grinding wheel 1, the area of its surface which comes into contact with the workpiece 2 is substantially reduced and brings about a material reduction in the number of contacting abrasive grains, with the result that the latter are rapidly loaded, consequently, the grade of finish of the workpiece 2 is raised. The number of contacting abrasive grains may be varied by varying the angle $\alpha$ through which the grinding wheel is rocked, thereby ensuring the required degree of roughness of the surface and the required degree of metal removal from the surface of the workpiece 2.

The proposed operation of the machine which is in fact a method of surface finishing, may be implemented at comparatively low rates of the relative displacement of the tool 1 and the workpiece 2.

Figure 3:
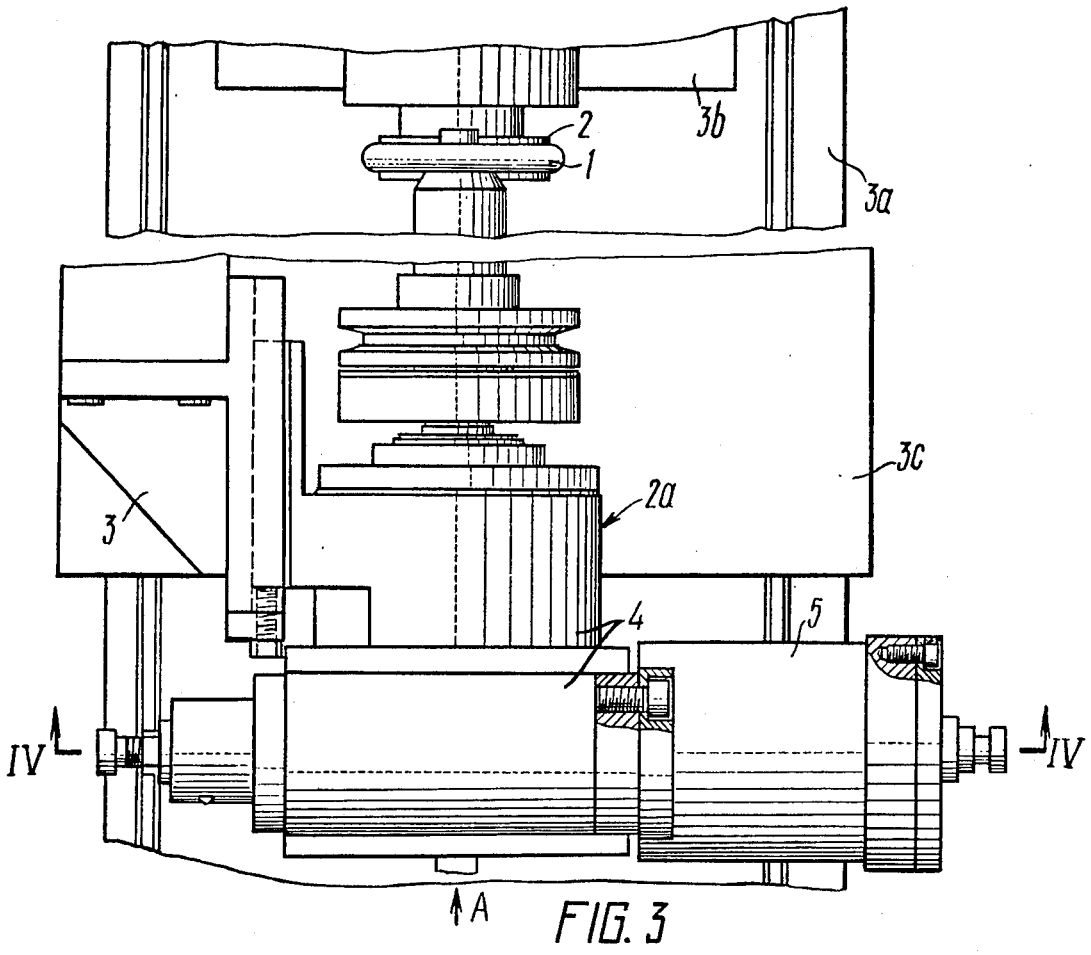
FIG. 3 is a plan view of a mechanism to impart a rocking motion to the spindle with the grinding wheel, shown mounted on a machine, giving a side view of the workpiece positioned behind the wheel.

The known grinding equipment does not permit finishing operations at such speeds, which is the reason why an exemplary grinding machine to implement the method of this invention is intended to provide the required rates of displacement of the grinding wheel 1 relative to the workpiece 2. To this end, the grinding machine is provided with a mechanism 2*a* (FIG. 3) which is mounted in a cantilever 3 attached to a bed 3*a* of the grinding machine (not shown) whereon there is mounted a table 3*b* on which the workpiece 2 is positioned and a saddle 3*c* carrying a spindle with the grinding wheel 1.

Figure 4:
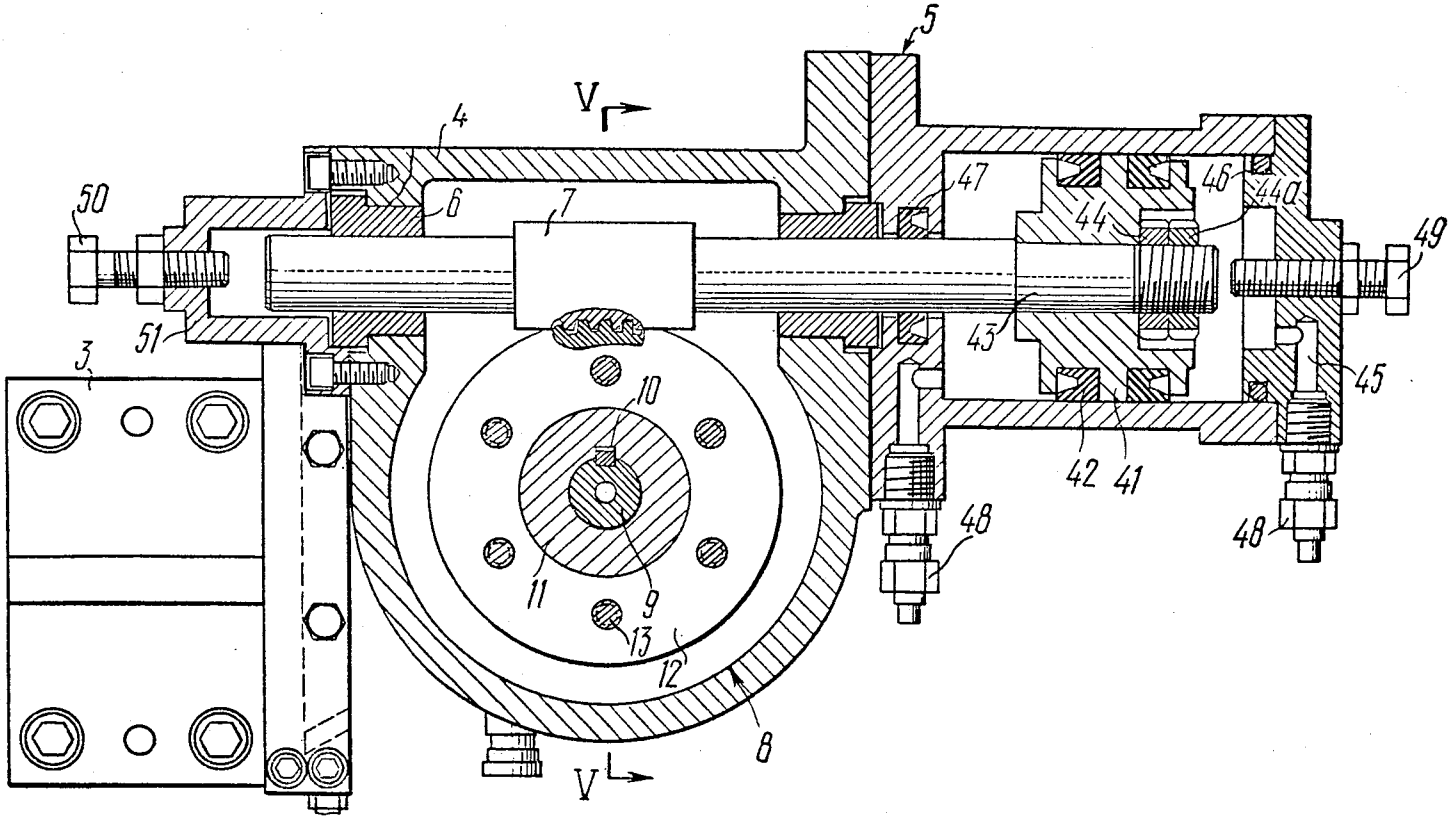
FIG. 4 is a section IV—IV of FIG. 3.

The mechanism 2*a* is housed in a case 4 formed as a casting with a flange whereby an actuating cylinder 5 serving as a drive of the mechanism 2*a* is coupled to the case 4. The mechanism 2*a* comprises a rack 7 mounted in guide bushings 6 (FIG. 4). The guide bushings 6 are press-fitted into the opposite walls of the case 4 coaxially one with the other. A gear rack 7 engages a gear 8 also mounted within the case 4 on a shaft 9.

Figure 5:
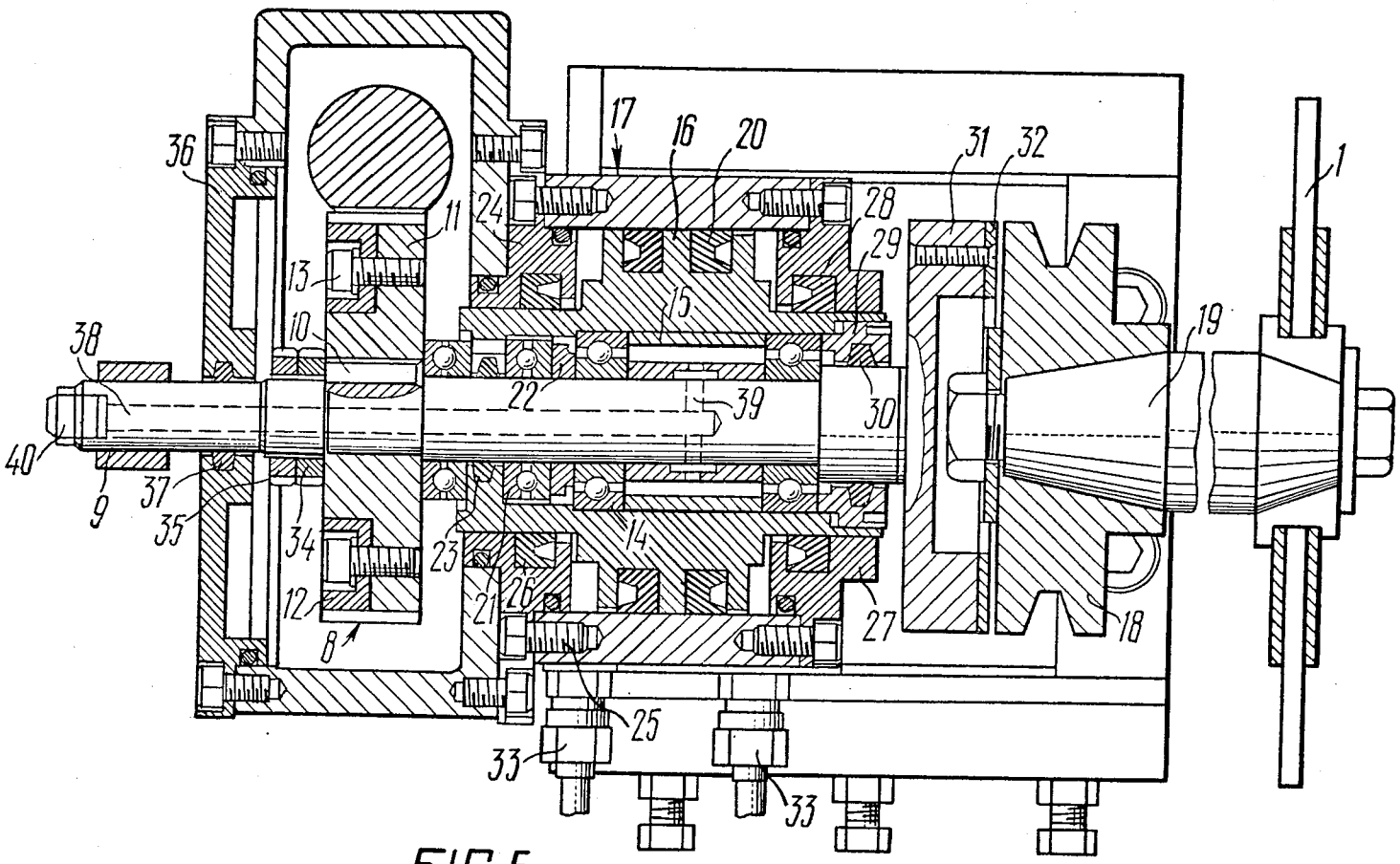
FIG. 5 is a section V—V in FIG. 4.

A key 10 is provided to transmit rotation from the shaft 9 to the gear 8. The gear 8 is made separable into two components: a boss 11 (FIG. 5) and a tooth rim 12 fixed on the boss 11 by screws 13.

With this design of the gear 8, there are no clearances between the surfaces of the teeth of the gear 8 and those of the rack 7. The right-hand (as seen in the drawing) portion of the shaft 9 is mounted in antifriction bearings 14 with spacer bushings 15 installed intermediate the rings of the antifriction bearings 14. The latter are press-fitted into the central axial hole of a piston 16 mounted so as to reciprocate in the cavity of an auxiliary cylinder 17 which serves to periodically bring the right-hand end of the shaft 9 into contact with the end face of a pulley 18 mounted on a spindle 19 with the grinding wheel 1. The pulley 18 is coupled with the main drive of the grinder by a texrope drive (not shown).

The piston 16 is mounted within the auxiliary cylinder 17 on packing collars 20. At the point where the shaft 9 passes from the case 4 into the auxiliary cylinder 17 thrust bearings 21 are mounted on the shaft 9, one thrust bearing (on the left in the drawing) adjoining the face of the gear 8, while the other is separated from the bearing 14 by an intermediate ring 22. On the outside the lateral surfaces of the thrust bearings 21 are in contact with the lateral surface of the central axial hole defined in the piston 16, and a circular lip formed in that axial hole separations one thrust bearing 21 from the other.

In the circular lip of the piston 16 there is formed a recess to receive a sealing ring 23. The left-hand (as seen in the drawing) end face of the auxiliary cylinder 17 is covered by a cap 24 with a hole wherethrough the end portion of the cylinder 16 is extended. In the cap 24, bolted to the left-hand end face of the auxiliary cylinder 17 by bolts 25, there is a circular recess to receive a seal 26 encircling the left-hand (as seen in the drawing) end of the piston 16. The cap 24 is provided with a cylindrical lug received in the hole in the wall of the case 4. A circular recess is formed in the lateral surface of the cylindrical lug for a sealing ring. The right-hand (as seen in the drawing) end face of the auxiliary cylinder 17 is likewise covered by a cap 27 having a hole wherethrough the end of the piston 16 is extended. In the cap 26 there is formed a recess to receive a seal 28 encircling the piston 16. A nut 29 with a sealing ring 30 is fitted into the central axial hole of the piston 16 over the right-hand (as seen in the drawing) end of the shaft 9. The nut 29 is intended to tighten the outer rings of the bearings 14 as well as to eliminate the clearances between each of them and the distance bushing 15 and between the left-hand bearing 14 and the piston 16. The right-hand (as seen in the drawing) end of the shaft 9 terminates in a disk 31 formed integral therewith and disposed exteriorly to the auxiliary cylinder 17. Fitted on the end face the disk 31 is a ring 32 made of a material with a high coefficient of friction such as, for example, forodo.

The ring 32 is in contact with the end face of the pulley 18 mounted on the spindle 19 of the grinder, the grinding wheel 1 being mounted on the other end of the spindle. The area of the ring 32 is chosen depending on the magnitude of the torque transmitted from the shaft 9 to the spindle 19.

The superpiston and subpiston cavities of the auxiliary cylinder 17 are provided with pipe connections 33 to supply and withdraw a pressurized medium such as compressed air, for example. A nut 34 and a lock nut 35 are mounted on the left-hand (as seen in the drawing) end of the shaft 9 to fix the gear 8 on the shaft 9. The free end of the shaft 9 extends beyond the case 4 through a cap 36 provided with a sealing ring 37.

A central axial hole 38 and radial holes 39 extending therefrom are formed in the shaft 9 to supply lubricant to the bearings 14. The mouth of the hole 38 of the shaft 9 is stoppered by a plug 40.

The actuating cylinder 5 (FIG. 4) adjoining the case 4 has a piston 41 with packing collars 42 encircling the lateral surface thereof. The piston 41 is fixed on a rod 43 made integral with the rack 7 by a nut 44 and a lock nut 44*a* mounted on the right-hand (as seen in the drawing) end of the rod 43.

The right-hand (as seen in the drawing) end face of the actuating cylinder 5 is covered by a cap 45 with a sealing ring 46. A sealing ring 47 is likewise provided at the point where the rack 7 enters the actuating cylinder 5.

The above-piston and below-piston spaces in the actuating cylinder 5 are fitted with pipe connections 48 wherethrough a pressurized medium is alternately supplied. The sequence in which the pressurized medium is supplied into one space or the other is controlled by a slide valve (not shown).

The axial displacement of the piston 41 is limited by check pieces 49 and 50 arranged coaxially with the rack 7. One of the check pieces 49 is installed in the cap 45 of the actuating cylinder 5, while the other is installed in a cap 51 covering the left-hand (as seen in the drawing) end of the rack 7. The stroke of the piston 41 is chosen as a function of the angle $\alpha$ through which the grinding wheel 1 is rocked, and the magnitude of the angle $\alpha$ through which the grinding wheel 1 is rocked is preset in each specific case depending on the required degree of roughness and the amount of metal to be removed from the surface of the workpiece 2, as well as on the workpiece material.

Figure 6:
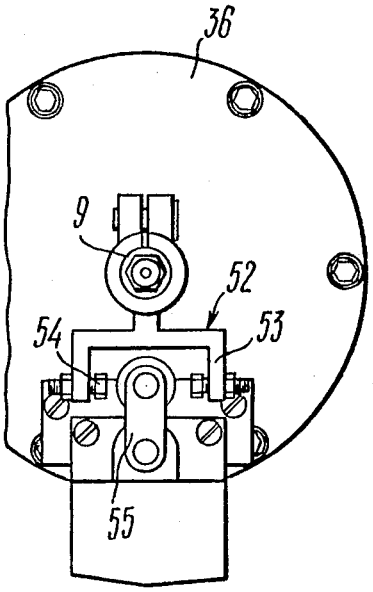
FIG. 6 is a view taken along the arrow A in FIG. 3.

For presetting the magnitude of the angle $\alpha$ through which the grinding wheel 1 is to be rocked there is provided a control 52 (FIG. 6) formed as a fork 53 rigidly fixed on the end of the shaft 9 exteriorly of the case 4. Fitted on the ends of the fork 53, coaxially one with the other, are adjusting screws 54 between which there is disposed a lever 55 kinematically coupled with the slide valve controlling the alternate supply of the pressurized medium into the cavities of the actuating cylinder 5.

The proposed grinder operates in the following way. After a slide valve (not shown) of the cylinder 5 has been actuated, a pressurized working medium is supplied via one of the pipe connections 48 into the above-piston space of the actuating cylinder 5, causing the piston 41 together with the rod 43, made integral with the rack 7 and coupled to the piston 41, to be displaced in the guide bushings 6 to the left (as seen in the drawing). The rack 7 is displaced, turning the gear 8 engaged thereby and transmitting the torque to the shaft 9 by way of the key 10.

Simultaneously, a pressurized medium is forced by the auxiliary cylinder slide valve through the left-hand (as seen in the drawing) pipe connection 33 into the above-piston space of the auxiliary cylinder 17, thereby causing the piston 16 to move to the right. Via the thrust bearing 21, the intermediate ring 22, the antifriction bearing 14 and the bushings 15, the pressure of the piston 16 is transmitted to the shaft 9, forcing the same to the right and causing the disk 31 with the friction ring 32 mounted on the end of the shaft 9 to be pressed against the end face of the pulley 18 so that the torque is transmitted from the shaft 9 to the spindle 19 and to the grinding wheel 1.

The piston 41 of the actuating cylinder 5 moves and the shaft 9 kinematically coupled therewith turns to one side through a certain arc until the fork 53 rigidly fixed on the end face of the shaft 9 presses by way of the adjusting screw 54 thereof against the lever 55, with the result that the slide valve of the actuating cylinder 5, kinematically coupled with the lever 55, is reversed and starts supplying the working medium through the left-hand pipe connection 48 into the below-piston space of the actuating cylinder 5, causing the piston 41 to move in the opposite direction. This causes the rack 7 to be moved to the right, turning the gear 8, so that the shaft 9 turns through a similar arc in the direction opposite to the initial one and reverses, at the end of the turn, the lever 55 coupled with the actuating cylinder slide valve, thus completing the rocking cycle of the shaft 9, whereupon the cycle starts all over again.

The rocking time of the shaft 9, and, consequently, of the grinding wheel 1, is preset by a timer (not shown). After the timer has operated, the slide valve of the actuating cylinder 5 supplies the pressurized working medium through the pipe connection 48 only to the above-piston space of the cylinder 5. The piston 41 arrives at its extreme left-hand position so that the rack 7 coupled with the piston 41 is abutted with the left-hand end face thereof against the check piece 50 arresting the axial displacement of the piston 41 and thus bringing the grinding wheel 1 to a full stop.

When the timer operates the next time, the pressurized working medium is forced by the slide valve of the auxiliary cylinder 17 via the pipe connection 33 to the above-piston space of the auxiliary cylinder 17, with the result that the piston 16 and the shaft 9 kinematically coupled therewith are returned to the initial position, wherein a clearance is established between the end face of the ring 32 mounted on the disk 31 and the end face of the pulley 18, the disk 31 being made integral with the shaft 9.

Figure 1:
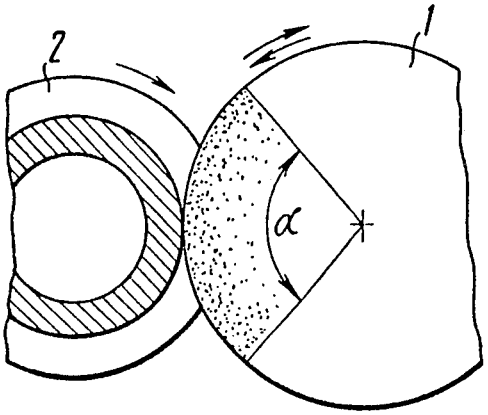
FIG. 1 is a side view showing the relative arrangement of a workpiece and a grinding wheel, the workpiece being in an end face view.
Figure 2:
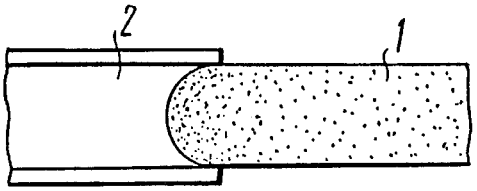
FIG. 2 is a top plan view of FIG. 1, the workpiece being visible from the top.

FIG. 1 schematically shows the rocking movement of the grinding wheel 1, by way of an exemplary angle alpha, with two arcuate, oppositely directed small arrows. The conventional rotational movement to which the workpiece 2 can be subjected is shown by a simple arrow (both on top of the figures). Both FIGS. 1 and 2 also exemplify, with the linear displacement that can be brought about between the axes of the wheel and the workpiece, once one or both of them become smaller, so that no abrasive action would take place without re-establishing contact.

It has been mentioned before that it is possible in the exemplary grinding machine to couple the grinding wheel with the main drive by means of a texrope drive. This rotational movement, which can be used for initial or rough machining, is not described in detail because it does not form part of the claimed invention. It is sufficiently described that the device for effecting the claimed machining method comprises the cylinder 17 and the piston 16, serving to connect the shaft 9 to the spindle of the grinding wheel and to disconnect it therefrom at the end of the machining cycle, as was described before.

For purposes of removing the main stock of a workpiece with the exemplary machine, the shaft 9 can be disconnected from the spindle of the grinding wheel, and the main drive switched on instead. After the main stock has been removed by "rotational grinding", the grinder motor is switched off, either with a clutch or simply by disconnecting the same from the mains, while the shaft 9 is re-connected to the spindle of the grinding wheel with the aid of the piston 16.

It has been described hereinbefore that the grinding wheel can be brought to a full stop at the finishing stage. The pressurized working medium is supplied, through the special-purpose slide valve of the cylinder 5, alternately into the right-hand or the left-hand pipe connections 48, causing the piston 41 to move accordingly. This of course results in the rocking motion of the grinding wheel about its axis. If the slide valve is set at a required moment in a position where the working medium is delivered only through one of the pipe connections 48, for instance, through the right-hand one, the piston 41, having moved to its extreme left position, will not move any more, and the grinding wheel will stop relative to the workpiece, which latter can be rotated.

Using the rocking of the grinding wheel, especially when the angle or arc thereof is gradually decreased, and then the wheel is stopped completely, one succeeds most efficiently in gradually reducing the roughness of the surface that is being machined, until the required degree of finish is attained.

The invention will be better understood and its various advantages more fully appreciated from the following two examples of practical application of the proposed method of machining.

EXAMPLE 1

The cylindrical surfaces of spindle and worm necks are machined to fine or extra fine quality grade and to the 9th grade of finish. The workpiece diameter is 200 mm; the length of the surface being machined is 200 mm.

With the prior methods of machining, the required grades of fit and finish can be achieved by a three-step procedure including rough and fine grinding and superfinish, with the total machining time averaging about 60 min.

Employing the method of this invention, the required grade of finish (∇ 9) and the predetermined quality (fine or extra fine) are attained in 25 min of preparatory grinding and 10 min of finishing with a rocking wheel. The optimum operating conditions are as follows:

| | |
|---|---|
| Workpiece speed | 150 m/min |
| wheel longitudinal feed | 1 m/min |
| wheel speed while removing the main allowance stock | 31 m/sec |
| wheel rocking speed at the stage of finishing | 20 m/min |
| wheel cross feed: | |
| at the stage of main allowance stock removal | 0.032 mm per run |
| at the finishing stage | 0.023 mm per run |
| wheel rocking angle at the finishing stage | 40° |
| wheel dimensions | 600 × 40 × 305 |
| main allowance stock removal time | 5 min |
| finishing time (rocking wheel) | 1.8 min |
| finishing time (retarded wheel) 3.2 min | |
| diamond dressing conditions: | |
| diamond cross feed | 0.04 mm/run -2 runs<br>0.01 mm/run -2 runs<br>0.00 mm/run -2 runs |
| diamond longitudinal feed | 0.48 m/min. |

Thus, to achieve the prescribed quality of the surface, the finishing time amounts to 10 minutes, a 1.7 — fold increase in labour productivity.

EXAMPLE 2

The inner races of ball bearings of inner diameter 30 mm and ball diameter 12 mm are finished under conditions of serial production.

| | |
|---|---|
| Operating conditions: | |
| workpiece speed | 180 m/min |
| wheel longitudinal feed | 0 m/min |
| wheel speed at the stage of main allowance stock removal | 35 m/sec |
| wheel rocking speed at the finishing stage | 20 m/min |
| wheel cross feed: | |
| at the stage of main allowance stock removal | 1.2 mm/min |
| at the finishing stage | 0.16 mm/min |
| wheel rocking angle at the finishing stage | 15° |
| main allowance stock removal time | 7 sec |
| finishing time (rocking wheel) | 8 sec |
| finishing time (retarded wheel) | 8 to 12 sec |
| retarded wheel cross feed | 0.16 mm/min |
| grinding wheel diameter | 300 mm. |

The total machining time here is equal to that of the prior art practice. But the known method gives a roughness of the machined surface of ∇ 7 and waviness of 0.8 μm, whereas the proposed method gives ∇ 10 – 11 and 0.1–0.2μm, respectively.

The rocking angle $\alpha$ of the wheel 1 is to be reduced and its linear velocity increased if a bigger wheel 1 is chosen, or if the workpiece 2 gets smaller, as well as in cases of reduced initial roughness of the surface, or wherever a higher grade of finish is required. And conversely, the rocking angle $\alpha$ of the wheel 1 is to be increased for a smaller wheel 1 and a larger workpiece 2, as well as when dealing with materials which are difficult to work or when the surface to be machined has a high degree of initial roughness.

When machining inner surfaces, the rocking angle $\alpha$ of the grinding wheel 1 must be larger than for outer surfaces.

What we claim is:

1. A grinding machine comprising:

a. a bed with a pair of sets of guides;

b. a table for positioning thereon a workpiece to be machined, said table being installed in one of said sets of guides;

c. a spindle with a grinding wheel thereon mounted in the other of said sets of guides;

d. a first mechanism to impart a rotary motion to at least one of said spindle and the workpiece; and e. a second mechanism to impart a rocking motion to said spindle in the plane of rotation of said wheel, said second mechanism including a rack, a drive to impart a reciprocating motion to said rack, and a gear which is kinematically coupled with said spindle interlinked with said rack.

2. The grinding machine of claim 1, wherein said drive comprises an actuating cylinder having a piston which is mechanically coupled with said rack.

3. The grinding machine of claim 1, wherein said first mechanism is arranged to impart a rotary motion to said spindle and said second mechanism is releasably connectable with said spindle, said first mechanism having a drive which is independent of said drive of said second mechanism.

4. The grinding machine of claim 1, comprising a saddle installed in said other of said sets of guides and a case for said second mechanism, said spindle being mounted on said saddle and said rack being housed in said case.

* * * * *